US010478957B1

(12) United States Patent
Keele

(10) Patent No.: US 10,478,957 B1
(45) Date of Patent: Nov. 19, 2019

(54) MODULAR TOOL HAVING A RIFLE BULLET CASING AS THE HANDLE

(71) Applicant: Austin Keele, Panguitch, UT (US)

(72) Inventor: Austin Keele, Panguitch, UT (US)

( * ) Notice: Subject to any disclaimer, the term of this patent is extended or adjusted under 35 U.S.C. 154(b) by 189 days.

(21) Appl. No.: 15/695,096

(22) Filed: Sep. 5, 2017

(51) Int. Cl.

| | |
|---|---|
| ***F23Q 2/00*** | (2006.01) |
| ***B25F 1/02*** | (2006.01) |
| ***B25B 15/00*** | (2006.01) |
| ***B25B 13/06*** | (2006.01) |
| ***B25B 23/00*** | (2006.01) |
| ***F23Q 1/02*** | (2006.01) |
| ***F41A 29/02*** | (2006.01) |
| ***F42B 5/26*** | (2006.01) |
| ***F42B 5/02*** | (2006.01) |
| ***B24D 15/08*** | (2006.01) |
| ***B25G 1/10*** | (2006.01) |

(52) U.S. Cl.
CPC ..... *B25F 1/02* (2013.01); *B24D 15/08* (2013.01); *B25B 13/06* (2013.01); *B25B 15/005* (2013.01); *B25B 23/0021* (2013.01); *B25B 23/0035* (2013.01); *B25G 1/10* (2013.01); *F23Q 1/02* (2013.01); *F41A 29/02* (2013.01); *F42B 5/025* (2013.01); *F42B 5/26* (2013.01)

(58) Field of Classification Search
CPC ..... B25F 1/02
USPC ..... 431/273; 43/23, 24
See application file for complete search history.

(56) References Cited

U.S. PATENT DOCUMENTS

| | | | | |
|---|---|---|---|---|
| 4,945,639 | A | 8/1990 | Kirby | |
| 5,868,048 | A | 2/1999 | Cassutti | |
| D444,171 | S | 6/2001 | McCullough | |
| 6,305,256 | B1 | 10/2001 | Anderson | |
| 6,374,711 | B2 | 4/2002 | Anderson | |
| D546,657 | S | 7/2007 | Buening | |
| D550,623 | S | 9/2007 | McCann | |
| 9,850,116 | B2 * | 12/2017 | Crane | B67B 7/0423 |
| 2010/0186559 | A1 | 7/2010 | Pell | |
| 2010/0263133 | A1 * | 10/2010 | Langan | B25D 1/00 7/143 |
| 2016/0185582 | A1 * | 6/2016 | Crane | B67B 7/0423 81/3.09 |

* cited by examiner

*Primary Examiner* — Avinash A Savani
(74) *Attorney, Agent, or Firm* — Kyle A. Fletcher, Esq.

(57) ABSTRACT

The modular tool having a rifle bullet casing as the handle is a tool that is adapted for multiple purposes. The modular tool having a rifle bullet casing as the handle is a kit. The modular tool having a rifle bullet casing as the handle comprises a handle, a connection and an instrument. The handle forms a grip that allows the modular tool having a rifle bullet casing as the handle to be manipulated by hand. The instrument forms the working element of the modular tool having a rifle bullet casing as the handle. The connection removably attaches the instrument to the handle. In the first potential embodiment of the disclosure, the handle comprises the cartridge of a bullet. In the first potential embodiment of the disclosure, the handle comprises the cartridge of a bullet.

16 Claims, 5 Drawing Sheets

MODULAR TOOL HAVING A RIFLE BULLET CASING AS THE HANDLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shaping including hand tool, more specifically, a multipurpose hand tool.

SUMMARY OF INVENTION

The modular tool having a rifle bullet casing as the handle is a tool that is adapted for multiple purposes. The modular tool having a rifle bullet casing as the handle is a kit. The modular tool having a rifle bullet casing as the handle comprises a handle, a connection and an instrument. The handle forms a grip that allows the modular tool having a rifle bullet casing as the handle to be manipulated by hand. The instrument forms the working element of the modular tool having a rifle bullet casing as the handle. The connection removably attaches the instrument to the handle. In the first potential embodiment of the disclosure, the handle comprises the cartridge of a bullet.

These together with additional objects, features and advantages of the modular tool having a rifle bullet casing as the handle will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular tool having a rifle bullet casing as the handle in detail, it is to be understood that the modular tool having a rifle bullet casing as the handle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular tool having a rifle bullet casing as the handle.

It is therefore important that the claims be regarded as including such equivalent construction insofar as they do not depart from the spirit and scope of the modular tool having a rifle bullet casing as the handle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
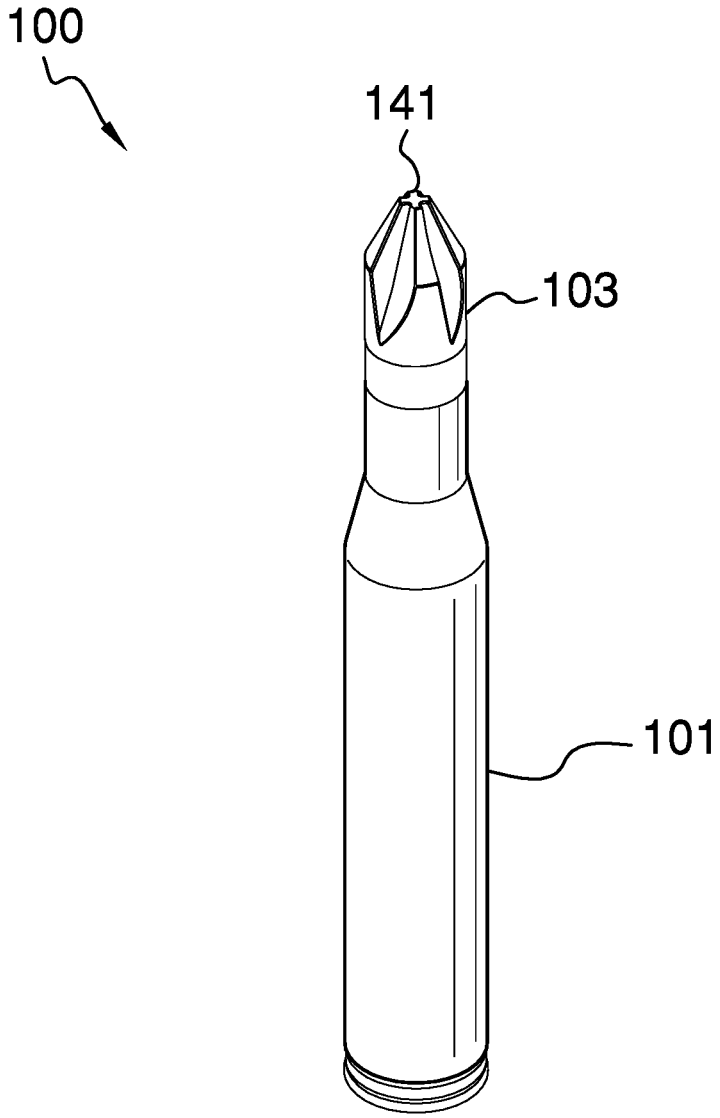
FIG. 1 is a perspective view of an embodiment of the disclosure.
Figure 2:
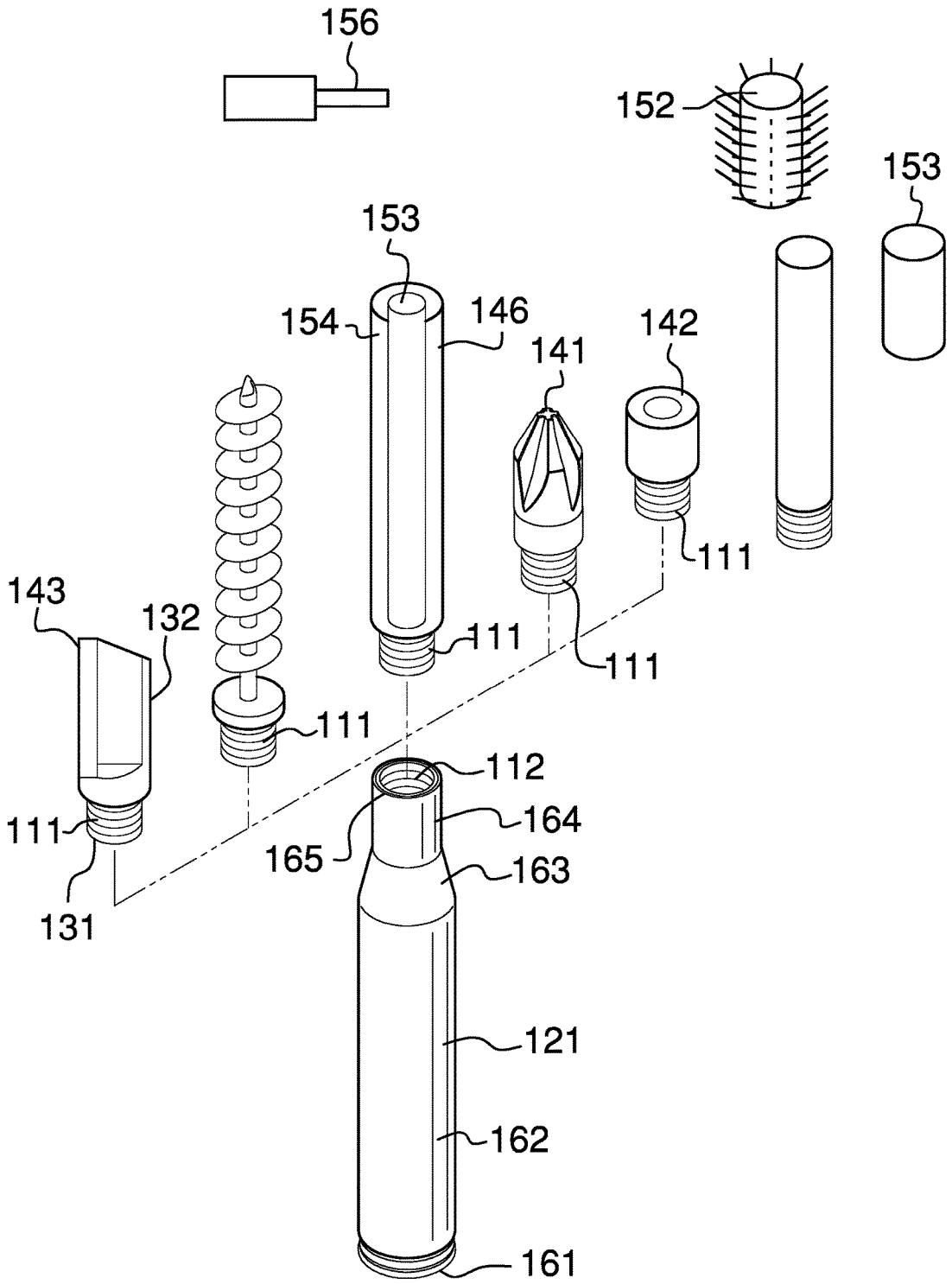
FIG. 2 is an exploded view of an embodiment of the disclosure.
Figure 3:
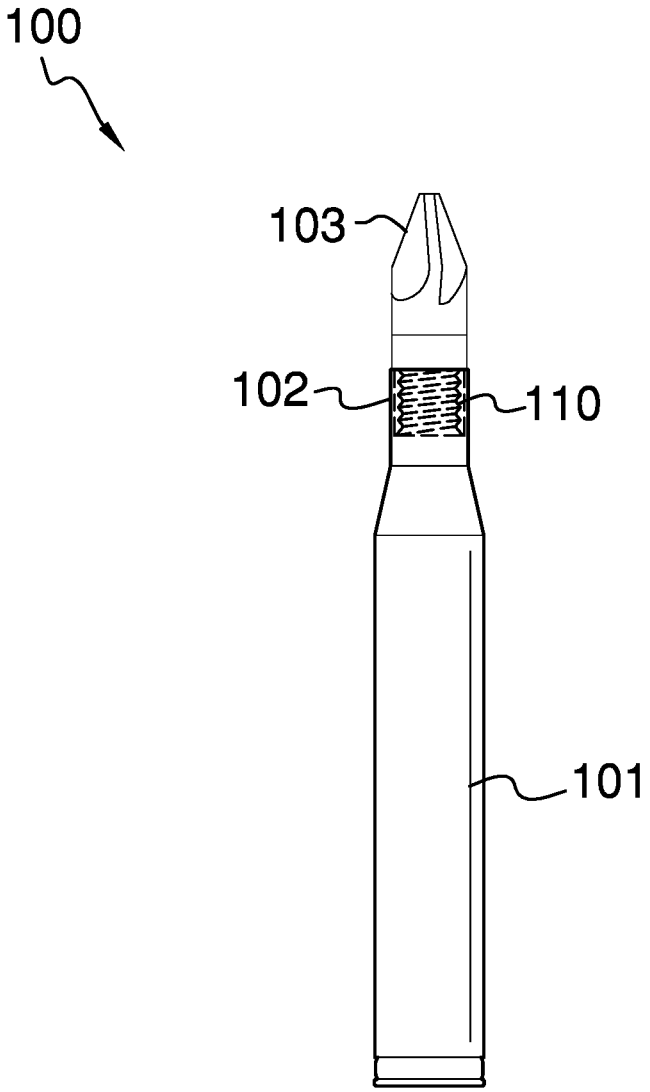
FIG. 3 is a front view of an embodiment of the disclosure.
Figure 4:
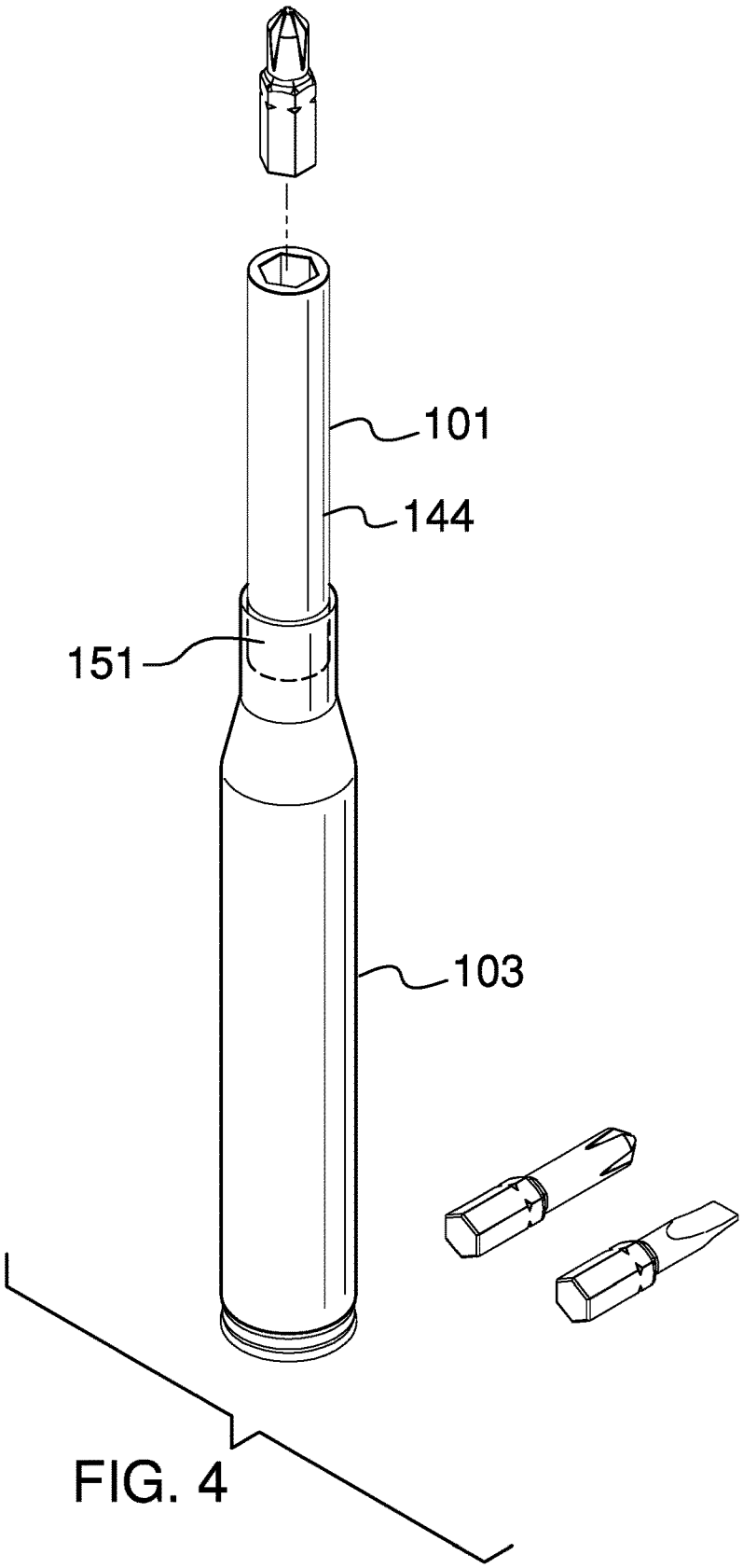
FIG. 4 is a perspective view of an alternative embodiment of the disclosure.
Figure 5:
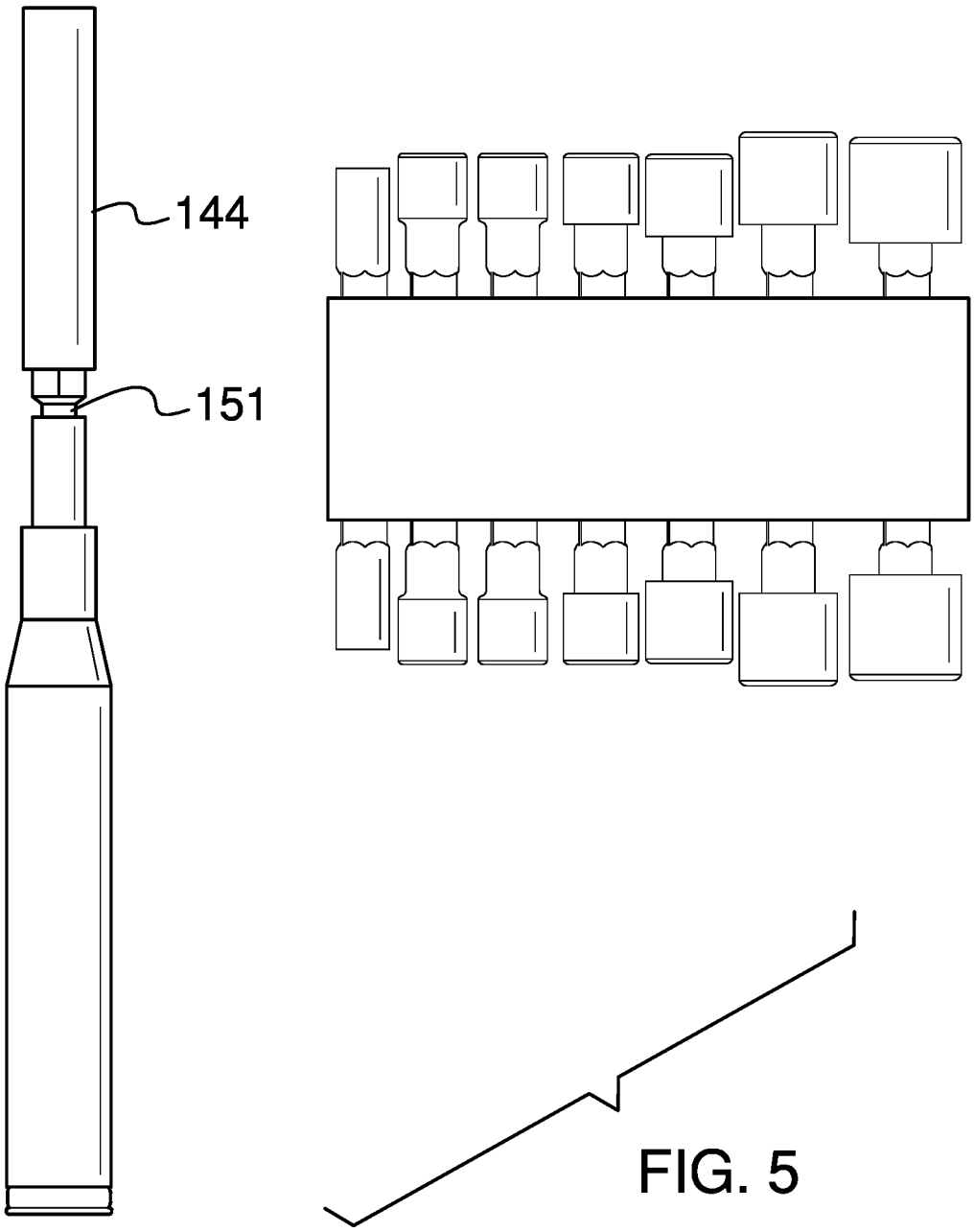
FIG. 5 is a perspective view of an alternative embodiment of the disclosure.

Detailed reference will now be made to one or more potential embodiments of the disclosure, which are illustrated in FIGS. 1 through 5.

The modular tool having a rifle bullet casing as the handle 100 (hereinafter invention) is a handheld tool that is adapted for multiple purposes. The invention 100 is a kit. The invention 100 comprises a handle 101, a connection 102 and an instrument 103. The handle 101 forms a grip that allows the invention 100 to be manipulated by hand. The instrument 103 forms the working element of the invention 100. The connection 102 removably attaches the instrument 103 to the handle 101. In the first potential embodiment of the disclosure, the handle 101 comprises the cartridge 121 of a bullet.

The handle 101 is a grip that allows the invention 100 to be manipulated by hand. The handle 101 comprises a cartridge 121. The cartridge 121 is further defined with a rim 161, a body 162, a shoulder 163, a neck 164, and a mouth 165.

The cartridge 121 is a roughly cylindrical device that is associated with ammunition for a firearm. During normal use, the cartridge 121 is intended to contain an explosive propellant and a projectile used as ammunition in a firearm. Within this disclosure, the cartridge 121 is used as the handle 101 of the invention 100.

The rim 161 refers to the end of the cartridge 121 that is distal from the mouth 165. The body 162 refers to the primary cylindrical structure of the cartridge 121 within which the explosive propellant is contained. The shoulder 163 refers to a location of the body 162 of the cartridge 121 where the diameter of the body 162 decreases. The neck 164 refers to the location of the cartridge 121 where the projectile of the cartridge 121 is mounted. The mouth 165 refers to an aperture formed in the neck 164 of the cartridge 121. The aperture formed by the mouth 165 is perpendicular to the center axis of the cartridge 121. During normal use of the cartridge 121, the explosive propellant and the projectile are inserted into the cartridge 121 though the mouth 165. During normal use of the invention 100, the base 131 of the instrument 103 is inserted into the mouth 165.

The cartridge 121 receives the base 131 of the instrument 103 in the mouth 165 of the cartridge 121. The interior screw thread 112 is formed in the mouth 165 of the cartridge 121 such that the base 131 of the instrument 103 may be screwed into the interior screw thread 112 to attach the instrument 103 to the handle 101.

While any cartridge 121 is suitable for use within this disclosure, the use of a 0.30 carbine cartridge or a 0.50 Browning machine gun cartridge is preferred.

The connection 102 is a mechanical device that attaches the instrument 103 to the handle 101. In the first potential embodiment of the disclosure, the connection 102 comprises a threaded connection 110. The threaded connection 110 is a fastening device that removably attaches the instrument 103 to the handle 101. Threaded connections 110 are discussed in greater detail elsewhere in this disclosure. The use of the threaded connection 110 allows instruments 103 to be interchanged during use of the invention 100.

The threaded connection 110 comprises an exterior screw thread 111 and an interior screw thread 112.

The exterior screw thread 111 is a helical structure that is formed on an exterior surface of the instrument 103. The exterior screw thread 111 is sized to match the interior screw thread 112. Exterior screw threads 111 are discussed in greater detail elsewhere in this disclosure.

The interior screw thread 112 is a helical structure that is formed on an interior surface of the handle 101. The interior screw thread 112 is sized to match the exterior screw thread 111. Interior screw threads 112 are discussed in greater detail elsewhere in this disclosure. The interior screw thread 112 is formed in the interior surface of the neck 164 by the mouth 165.

In a second potential embodiment of the disclosure, the connection 102 comprises an epoxy adhesive. More specifically, the base 131 of the instrument 103 is inserted directly into the mouth 165 of the cartridge 121 and is directly adhered to the neck 164 of the cartridge 121 using a commercially available epoxy. The use of epoxies for this purpose is well known in the mechanical arts.

The instrument 103 is an implement that performs that actual task for which the instrument 103 is designated. The instrument 103 comprises a base 131 and a working tip 132. The instrument 103 may be broadly thought of as a cylindrical structure. The ends of the cylinder form the base 131 and the working tip 132. The base 131 is the end of the instrument 103 that is attached to the mouth 165 of the cartridge 121. The exterior screw thread 111 is formed at the base 131 of the instrument 103. The working tip 132 is the end of the instrument 103 that is distal from the base 131. The working tip 132 forms the physical implement that performs the designated task of the instrument 103.

In the first potential embodiment of the disclosure, the working tip 132 of the instrument 103 is selected from the group consisting of a screw driver 141, a socket 142, a knife sharpener 143, a bit extension 144, and a cleaning rod 145, and a fire starter 146.

The screw driver 141 is an instrument 103 wherein the implement of the instrument 103 is formed such that the implement will fit into a screw thereby allowing the screw to be rotated. The socket 142 is an instrument 103 formed as a hollow cylindrical device that is placed around a nut type object such that the nut type object may be rotated by the invention 100. The knife sharpener 143 is an instrument 103 that is formed with an abrasive surface such that the knife sharpener 143 may be used to grind and polish a sharp edge on a tool such as a knife.

The bit extension 144 is a cylindrical structure that: 1) attaches to the interior screw thread 112 of the handle 101; 2) extends the span of the invention 100 in the direction of the center axis of the cartridge 121; and, 3) adapts the invention 100 such that commercially available bits commonly used with power drills may be used with the invention 100. The bit extension 144 further comprises a threaded post 151. The threaded post 151 is a projection that is formed on the end of the bit extension 144 that is attached to the handle 101. The threaded post 151 is formed with an exterior screw thread 111 that attaches to the interior screw thread 112 to form the threaded connection 110.

The cleaning rod 145 is an instrument 103 that is used to clean a firearm after the firearm has been discharged. The cleaning rod 145 is sized to be inserted into the barrel of a firearm. The cleaning rod 145 further comprises a brush 152, and a patch holder 153. The brush 152 attaches to the cleaning rod 145. The brush 152 is inserted into the barrel for the purpose of removing detritus from and applying a lubricant to the interior surface of the barrel. The patch holder 153 attaches to the cleaning rod 145. The patch holder 153 is used to polish the interior surface of the barrel of a firearm.

The fire starter 146 is a cylindrical chemical device that may be used to start a fire. The fire starter 146 further comprises a steel cylinder 154, an epoxy and magnesium insert 155, and a flint striker 156. The steel cylinder 154 refers to a cylindrical steel tube. A flint is struck against the working tip 132 of the steel cylinder 154. The flint striker 156 is a commercially available device that provides a flint surface. When the flint striker 156 is struck against the steel cylinder 154 sparks are created that are used to ignite the epoxy and magnesium insert 155.

The epoxy and magnesium insert 155 refers to a solid material formed from a resin comprising a mixture of epoxy and magnesium. The epoxy and magnesium insert 155 is a readily combustible material that can be used to initiate a fire. The magnesium contained within the epoxy and magnesium insert 155 is an accelerant that: 1) initiates the combustion of the epoxy and magnesium insert 155; and 2) ensures that the epoxy and magnesium insert 155 will be fully consumed by the combustion reaction. The epoxy contained within the epoxy and magnesium insert 155 provides the fuel required to support the combustion reaction. The epoxy and magnesium insert 155 is formed as a cylindrical structure that is sized such that the epoxy and magnesium insert 155 may be inserted into the steel cylinder 154.

The following definitions were used in this disclosure:

Accelerant: As used in this disclosure, an accelerant is a chemical that speeds up the chemical reaction of combustion.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Detritus: As used in this disclosure, detritus refers to an accumulation of unwanted material on a surface.

Exterior Screw Thread: An exterior screw thread is a ridge wrapped around the outer surface of a tube in the form of a helical structure that is used to convert rotational movement into linear movement.

Firearm: As used in this disclosure, a firearm is a handheld weapon designed to expel a projectile which has been accelerated using a mechanism comprising an explosion.

Grip: As used in this disclosure, a grip is an accommodation formed within an object that allows the object to be grasped or manipulated by a hand.

Handheld: As used in this disclosure, when referring to an item or device, handheld means that the item or device is small and light enough to be operated while a person holds the item or device in their hands.

Handle: As used in this disclosure, a handle is an object by which a tool, object, or door is held or manipulated with the hand.

Interior Screw Thread: An interior screw thread is a groove that is formed around the inner surface of a tube in the form of a helical structure that is used to convert rotational movement into linear movement.

Nut: As used in this disclosure, a nut is a first object that is formed with an interior screw thread such that a second object with a matching exterior screw thread can screwed into the first object forming a threaded connection.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A multipurpose tool comprising:

a handle, a connection and an instrument;

wherein the connection removably attaches the instrument to the handle;

wherein the handle forms a grip that allows the multipurpose tool to be manipulated by hand;

wherein the instrument forms the working element of the multipurpose tool;

wherein the handle comprises the cartridge of a bullet;

wherein the cartridge is further defined with a rim, a body, a shoulder, a neck, and a mouth;

wherein in the working tip of the instrument is selected from the group consisting of a screw driver, a socket, a knife sharpener, a bit extension, and a cleaning rod, and a fire starter;

wherein the fire starter further comprises a steel cylinder, an epoxy and magnesium insert, and a flint striker;

wherein the steel cylinder comprises a cylindrical steel tube;

wherein the flint striker is a device that provides a flint surface;

wherein when the flint striker is struck against the steel cylinder sparks are created that are used to ignite the epoxy and magnesium insert;

wherein the epoxy and magnesium insert is a solid material formed from a resin comprising a mixture of epoxy and magnesium;

wherein the epoxy and magnesium insert is formed as a cylindrical structure that is sized such that the epoxy and magnesium insert may be inserted into the steel cylinder.

2. The multipurpose tool according to claim 1 wherein the mouth of the cartridge receives the instrument.

3. The multipurpose tool according to claim 2 wherein the connection is selected from the group consisting of a threaded connection or an epoxy.

4. The multipurpose tool according to claim 3 wherein the instrument is an implement that performs that actual task for which the instrument is designated.

5. The multipurpose tool according to claim 4 wherein the instrument comprises a base and a working tip;

wherein the base is the end of the instrument that is attached to the mouth of the cartridge;

wherein the working tip is distal from the base;

wherein the working tip forms the physical implement that performs the designated task of the instrument.

6. The multipurpose tool according to claim 5 wherein the screw driver is an instrument wherein the implement of the instrument is formed such that the implement will fit into a screw.

7. The multipurpose tool according to claim 6 wherein the socket is formed as a hollow cylindrical device that is placed around a nut type object.

8. The multipurpose tool according to claim 7 wherein the knife sharpener is an instrument that is formed with an abrasive surface;

wherein the knife sharpener grinds and polishes a sharp edge on a tool.

9. The multipurpose tool according to claim 8 wherein the bit extension is a cylindrical structure;

wherein the bit extension attaches to the interior screw thread of the handle;

wherein the bit extension extends the span of the multipurpose tool in the direction of the center axis of the cartridge;

wherein the bit extension adapts the multipurpose tool such that bits used with power drills may be used with the multipurpose tool.

10. The multipurpose tool according to claim 9 wherein the cleaning rod is an instrument that is used to clean a firearm after the firearm has been discharged;

wherein the cleaning rod is sized to be inserted into the barrel of a firearm.

11. The multipurpose tool according to claim 10 wherein the cleaning rod further comprises a brush, and a patch holder;

wherein the brush attaches to the cleaning rod;

wherein the patch holder attaches to the cleaning rod.

12. The multipurpose tool according to claim 11 wherein the fire starter further comprises a steel cylinder, an epoxy and magnesium insert, and a flint striker;

wherein the steel cylinder comprises a cylindrical steel tube;

wherein the flint striker is a device that provides a flint surface;

wherein when the flint striker is struck against the steel cylinder sparks are created that are used to ignite the epoxy and magnesium insert;

wherein the epoxy and magnesium insert is a solid material formed from a resin comprising a mixture of epoxy and magnesium;

wherein the epoxy and magnesium insert is formed as a cylindrical structure that is sized such that the epoxy and magnesium insert may be inserted into the steel cylinder.

13. The multipurpose tool according to claim 12, wherein the connection comprises a threaded connection;

wherein the use of the threaded connection allows instruments to be interchanged;

wherein the threaded connection comprises an exterior screw thread and an interior screw thread;

wherein the exterior screw thread is a helical structure that is formed on an exterior surface of the instrument;

wherein the exterior screw thread is sized to match the interior screw thread;

wherein the interior screw thread is a helical structure;

wherein the interior screw thread is sized to match the exterior screw thread.

14. The multipurpose tool according to claim 13 wherein the interior screw thread is formed in the mouth of the cartridge such that the base of the instrument may be screwed into the interior screw thread to attach the instrument to the handle;

wherein the interior screw thread is formed in the interior surface of the neck.

15. The multipurpose tool according to claim 14 wherein the exterior screw thread is formed at the base of the instrument.

16. The multipurpose tool according to claim 1 wherein the cartridge is selected from the group consisting of a 0.30 carbine cartridge or a 0.50 browning machine gun cartridge.

* * * * *